United States Patent [19]

Haab et al.

[11] Patent Number: 4,815,797

[45] Date of Patent: Mar. 28, 1989

[54] FURNITURE DOOR

[76] Inventors: Karl Haab, Obere Weidstrasse 7, Rotkreuz; Otto Haab, Zurichstrasse 25, Mettmenstetten, both of Switzerland

[21] Appl. No.: 64,116

[22] Filed: Jun. 18, 1987

[30] Foreign Application Priority Data

Jul. 2, 1986 [CH] Switzerland ..... 2659/86

[51] Int. Cl.[4] ..... A47B 88/00

[52] U.S. Cl. ..... 312/322; 49/257

[58] Field of Search ..... 312/322, 323; 49/126, 49/127, 257, 258, 254

[56] References Cited

U.S. PATENT DOCUMENTS

| | | | |
|---|---|---|---|
| 972,412 | 10/1910 | Taussig | 49/257 |
| 1,606,587 | 11/1926 | May | 312/322 X |
| 2,038,035 | 4/1936 | Friedrich | 312/322 X |
| 2,284,531 | 5/1942 | Miller | 312/323 X |
| 2,769,678 | 11/1956 | Wolters | 312/323 X |
| 3,456,995 | 7/1969 | Nyquist | 312/322 |
| 4,058,932 | 11/1977 | Peterson et al. | 49/257 |
| 4,692,838 | 9/1987 | Merchant | 49/176 X |

*Primary Examiner*—Joseph Falk

*Attorney, Agent, or Firm*—Helfgott & Karas

[57] ABSTRACT

A door mounting assembly for a hollow cabinet utilizes a pair of vertically inclined elongated scissor members pivotally secured together at aligned centers lying in a place adjacent one side wall of the cabinet. The members are movable between a first compressed position and a second expanded position. Upper and lower horizontal guides are secured to the inner surfaces of the top and bottom of the cabinet. A vertical elongated third member is selectively secured both pivotally and slidably to the scissor members and is disposed in the guides. An end of one of the scissor members is pivotally secured to and is vertically slidable in a vertical support fixed in position in the cabinet.

11 Claims, 4 Drawing Sheets

FIG. 8
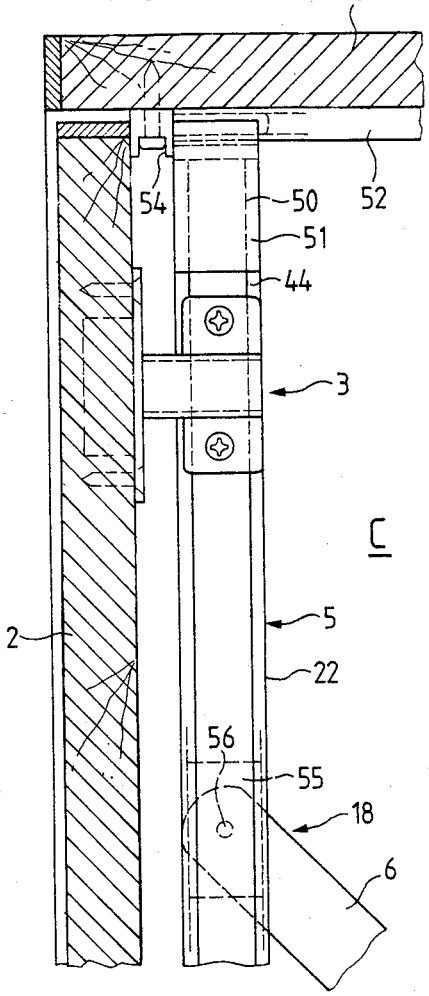
FIG. 10
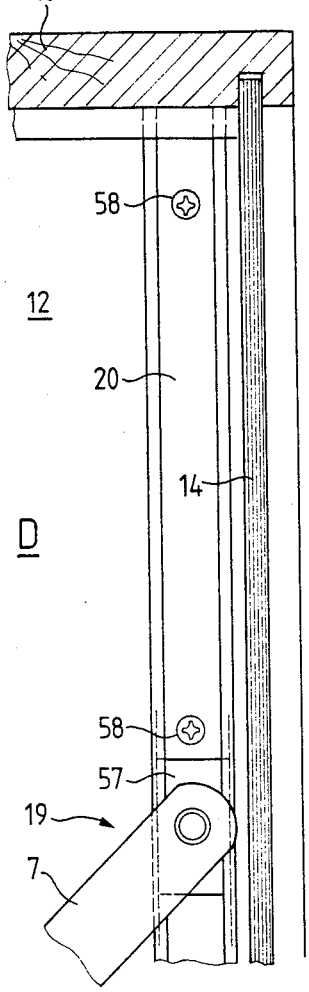
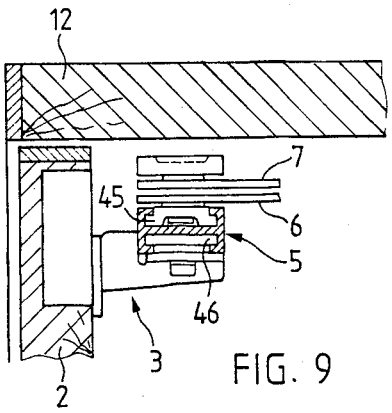
FIG. 9
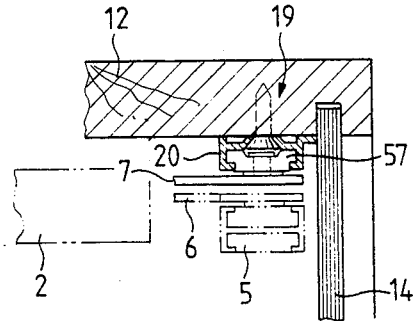
FIG. 11

FURNITURE DOOR

BACKGROUND OF THE INVENTION

The invention relates to a door for a piece of furniture, particularly a cupboard, which is connected to a scissor arm system including two scissor arms and a stop bar. After opening, the door can be swung perpendicular to the closed position and can be slid back from the front surface of the piece of furniture parallel to the lateral surface thereof.

In various known arrangements doors in cupboards can be secured to a scissor arm system whereby after the door is opened, the door can be slid back on the side of the cupboard or other piece of furniture. This slide back construction which can be supplied from the side of the cupboard is admittedly more complicated than the conventional embodiment of a door fixed by hinges to the side wall of the cupboard, but has the advantage that on opening the door does not project into the room and impede passage in front of the cupboard. In one known embodiment of such a slide back cupboard door (U.S. Pat. No. 972,412), the door is fixed by means of hinges to a stop bar. The bar is carried by a scissor system employing two crossed rods, whose displaceable joints are guided by means of a sliding guide on the cupboard wall or a guide profile fixed to the stop bar. However, this embodiment has the disadvantage that even in the case of the most careful assembly, it is virtually impossible to avoid jamming of the sliding guide, and this can occur even with the smallest dimensional tolerances.

In another known embodiment of a slide back cupboard door (German Patent No. 2,045,763), this disadvantage occurring with scissor arm systems can be overcome when each displaceable joint has a castor guide comprising a castor guided in a guide piece. The two scissor joints arranged in the stop bar and the door hinges, are, however, only vertically adjustable. This embodiment has proved satisfactory in practice, but suffers from the disadvantage of requiring a relatively complicated and expensive construction.

The problem of the present invention is to provide a door assembly particularly for a cupboard, which overcomes the problem of jamming and at the same time can be constructed easily and less expensively.

SUMMARY OF THE INVENTION

It is an object of the present invention to provide a mounting assembly for a door in a cabinet which enables the door to be closed or opened in slide back position which is characterized by a jam-free relatively simple and inexpensive construction.

Another object is to provide a new mounting assembly of the character indicated which can be easily installed and removed even after the cabinet has been completely constructed.

In accordance with the principles of the invention, a mounting assembly is provided for mounting a door in the opening of a front vertical wall of a cabinet having a hollow interior with a horizontal top and a horizontal bottom interconnected by the front wall. The Cabinet has vertical parallel oppositely disposed side walls disposed at right angles to the front wall and has a rear wall disposed parallel to the front wall. The top, bottom, side walls and front and rear walls have inner surfaces.

The assembly includes a pair of vertically inclined elongated scissor members pivotally secured together at their aligned centers. These members lie in a vertical plane adjacent but spaced from one selected side wall. One member has a first upper end and a second lower end. The other member has a third upper end and a fourth lower end. The members are movable between a first compressed position at which the first and second ends are disposed adjacent the corresponding third and fourth ends respectively and a second expanded position at which the first and second ends are displaced a substantially larger distance from the corresponding third and fourth ends respectively. Upper and lower horizontal guides are secured to the inner surfaces of the top and bottom respectively. The guides lie in said vertical plane. The third end is pivotally secured to the lower guide adjacent the rear wall. A vertically elongated stop lies in said vertical plane and extends between and slidably engaging said guides. The first and fourth ends pivotally engage said stop. The first end is vertically slidable in said stop. A vertically elongated support is secured to the rear wall and lies in said plane, the second end pivotally engaging and being vertically slidable in the support.

The door has opposite side edges, one of the door edges being hingedly secured to the stop. The door has a closed position at which it closes the opening in the front wall and the members are in the expanded position and has an open position at which it is disposed parallel to the side walls and lies in said plane and the members are in the compressed position.

The upper and lower guides of the stop bar can be webs, which are placed on the base and below the top of the piece of furniture and can be enveloped by the stop bar. Thus, the webs can be adapted and in the case of normal assembly precision, freedom from jamming of the scissor arm system is obtained.

The aforementioned objects and advantages of the invention as well as other objects and advantages thereof will either be explained or will become apparent to those skilled in the art when this specification is read in conjunction with the accompanying drawings and specific description of preferred embodiments which follow.

BRIEF DESCRIPTION OF THE DRAWINGS

FIG. 8 illustrates area C of FIG. 1 in larger scale.

FIG. 9 is a plan view of area C of FIG. 1 in larger scale.

FIG. 10 illustrates area D of FIG. 1 in larger scale.

FIG. 11 is a plan view of area D of FIG. 1 in larger scale.

DETAILED DESCRIPTION OF PREFERRED EMBODIMENTS

Figure 1:
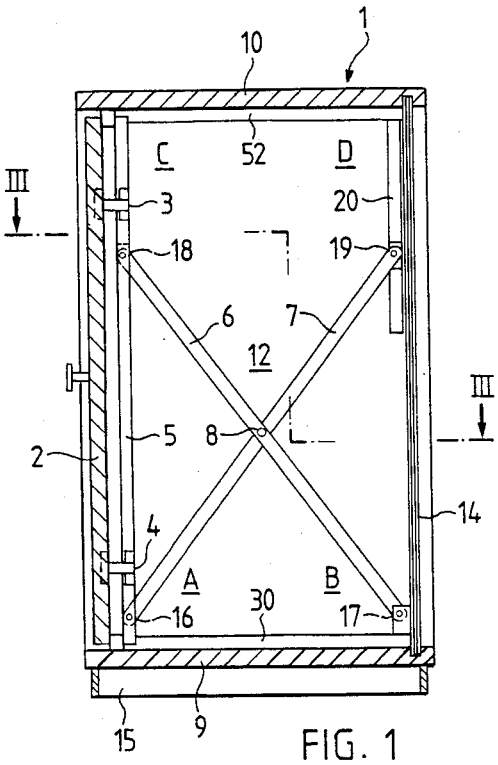
FIG. 1 shows one embodiment of the invention in vertical cross section which illustrates a cupboard with a door connect to the cupboard via a scissor arm system.
Figure 2:
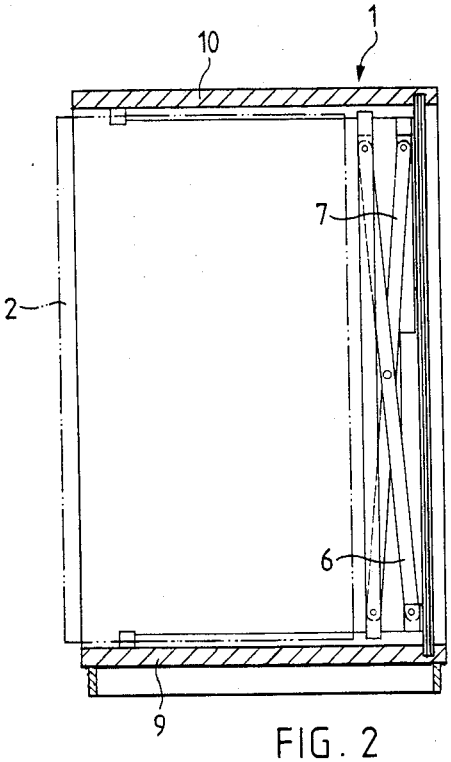
FIG. 2 is a view similar to FIG. 1 but showing the door in a different position.
Figure 3:
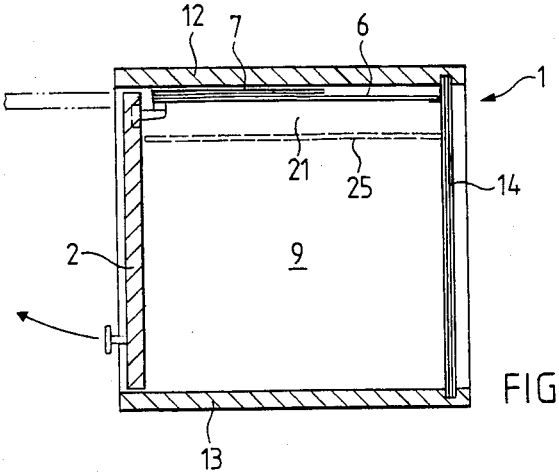
FIG. 3 is a horizontal section through the cupboard of FIGS. 1 and 2 taken along line III—III in FIG. 1.

FIGS. 1 to 3 show a piece of furniture 1, e.g. a cupboard, provided with a door 2. Door 2 is pivotably disposed in the cupboard with the aid of hinges, e.g. cup-shaped hinges 3, 4 to stop bar 5, which is secured by scissors arms 6 and 7. Stop bar 5 is constructed with a central portion having a profile or section 22 with two dovetail guides, as shown in FIG. 9. Hinges 3, 4 can be vertically adjusted in these guides, so that the height of the door can be adjusted.

Scissor arms 6, 7 are coupled together in pivotal manner at their central intersecting point by a screw bolt 8, or other known means.

The cupboard 1 has a flat horizontal base 9, a parallel top 10, vertical parallel sides 12, 13 and a vertical rear wall 14, the base 9 being provided with a base frame 15. The door is disposed in an opening in a vertical front wall which is parallel to wall 14 and is disposed at right angles to sides 12, 13.

Scissor arms 6, 7 are connected by means of swivel joints 16, 17 and slide-swivel joints 18, 19 to the stop bar 5 or cupboard 1. Swivel joint 17 and slide-swivel joint 19 are e.g. fixed to side 12, whereas slide-swivel joint 19 are is displaceably guided in a profile strip 20 With a dovetail guide as shown in FIG. 11. Alternatively the swivel joint 17 and slide-swivel joint 19 can be secured to rear wall 14. The scissor arm system 6, 7 and stop bar 5 with door 2 can also be placed on the other side 13, it merely being necessary to pivot, but in no other way modify the parts. The cupboard area 21 required by the scissor arm system 6, 7 and door 2 on sliding in can be separated from the remaining cupboard area by an additional wall 25.

Figure 4:
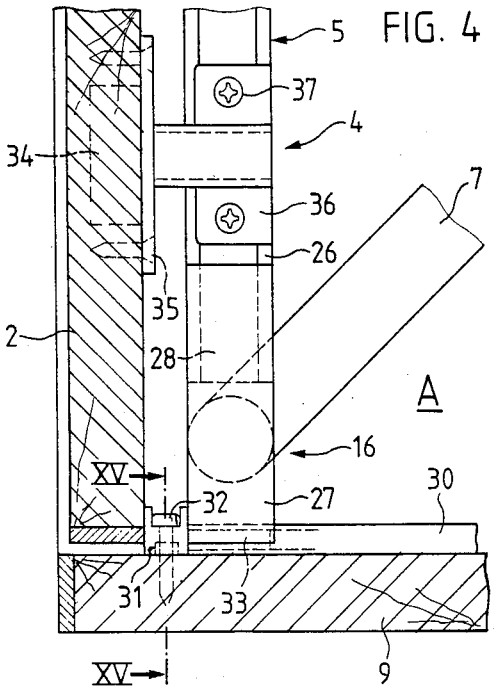
FIG. 4 illustrates area A of FIG. 1 in larger scale.
Figure 5:
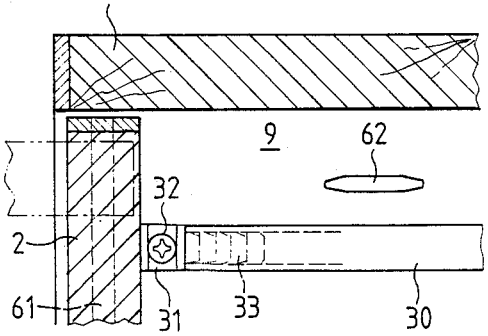
FIG. 5 is a plan view of area A of FIG. 1 in larger scale.

FIGS. 4 to 11 show areas A to D of FIG. 1 on a larger scale and comprising corresponding ones of the joints 16–19. FIGS. 4 and 5 show area A, i.e. essentially the base-side end 26 of stop bar 5 with hinge 4 and swivel joint 16. To an end 26 of central part 22 is secured a base piece 27, which also carries the swivel joint 16, as will be described relative to FIG. 13. Base piece 27 is a component, [a plastic part, metal part or the like] pressed by means of a securing tongue 28 into one of the two dovetail grooves of stop bar 5. Base piece 27 envelops a lower guide 30 in the form of a web and is supported thereon, so that consequently the scissor arm system 6, 7 is free of the weight of door 2. The lower guide web 30 has a stop 31, which is fixed to the base by means of a screw 32. Stop 31 is an e.g. plastic part, which is pressed by means of a securing tongue 33 into the central part 22 of stop bar 5 which is appropriately constructed as a profile strip 20. The bore or screw 32 in stop 31 is laterally extended, so that it provides a possibility for adjusting lower guide 30. Through the lateral displacement of the lower guide web 30, it is possible to precisely adjust door 2. It is sufficient if only the front end of guide web 30 is laterally displaceable. Stop 31 together with a variant will be described in greater detail relative to FIGS. 15, 16 and 17.

The cup-shaped hinges 3, 4 are generally known fittings, in which one hinge part 34 is countersunk in door 2 and fixed with screws 35, and the other hinge part 36 is fixed in vertically adjustable manner by means of screws 37 in one of the two dovetail profiles of stop bar 5.

Figure 6:
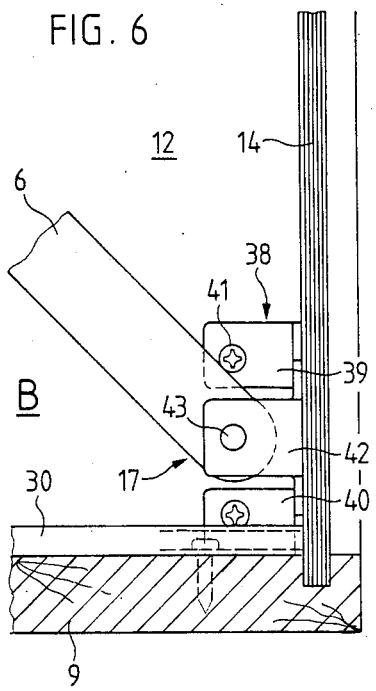
FIG. 6 illustrates area B of FIG. 1 in larger scale.

FIG. 6 shows on a larger scale area B with swivel joint 17. As can be seen from FIGS. 6 and 7, a U-shaped section 38 with securing lugs 39, 49 is provided in side 12 and fixing thereof in the latter takes place by means of screws 41. Leg 42 of the U-shaped section 38, together with the end of scissor arm 6 and a bolt 43 forms the swivel joint 17.

Figure 7:
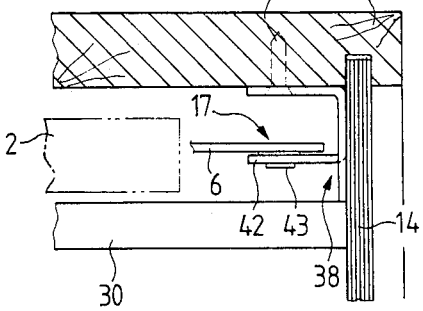
FIG. 7 is a plan view of area B of FIG. 1 in larger scale.

FIG. 7 also shows how far door 2 can be slid back. Stop bar 5 is located alongside leg 42, cf. FIG. 11, where said bar 5 is alongside the slide-swivel joint 19.

FIGS. 8 and 9 show area C in FIG. 1 on a larger scale. At its top-side end 44, stop bar 5 has a head piece 50, cf. FIG. 12. Head piece 50, e.g. a plastic part, has a securing tongue 51, similar to securing tongue 28 of base piece 27 and by means of which it is pressed into a dovetail groove of stop bar 5. Head piece 50 embraces an upper guide 52 constructed in the same way as stop 31 of lower guide 30. It is also laterally adjustable.

FIGS. 8 and 9 also show the upper cup-shaped hinge 3, whose hinge parts are fixed to the stop bar 5 or door 2 in the same way as hinge part 4, cf FIG. 4. The slide-swivel joint 18 has a sliding plate 55, on which is pivotably mounted by means of a bolt 56 the end of scissor arm 6.

FIG. 9 shows the construction of stop bar 5 in the form of a profile strip 20 with the two dovetail grooves 45, 46. The slide-swivel guide 18 is displaceably guided in dovetail groove 45, and the cup-shaped hinges 3, 4 are fixed in dovetail groove 46.

FIGS. 10 and 11 show area D of FIG. 1 on a larger scale. In the same way as the slide-swivel joint 19, slide swivel joint 19 is provided with a sliding plate 57, which is displaceably guided in profile strip 20 and together with the end of scissor arm 7 forms the slide-swivel joint 19. FIG. 11 shows the rear end of door 2 when completely slid back, in which position the stop bar 5 is at the same level as profile strip 20.

Profile strip 20 is fixed by means of screw 58 in side 12. Stop bar 5 and profile strip 20 can be used without machining, even when the scissor arm system 6, 7 is used on the opposite side 13.

Figure 12:
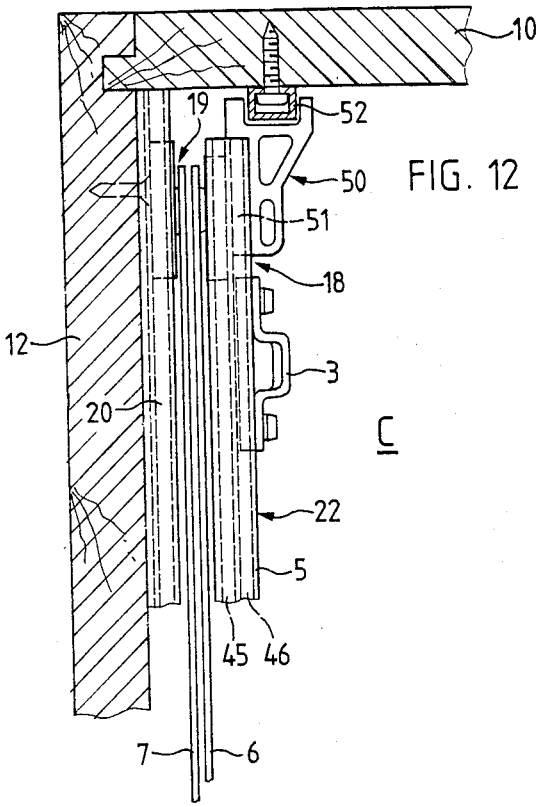
FIG. 12 is a detail side view showing the top-side end of the stop bar with a head piece.
Figure 13:
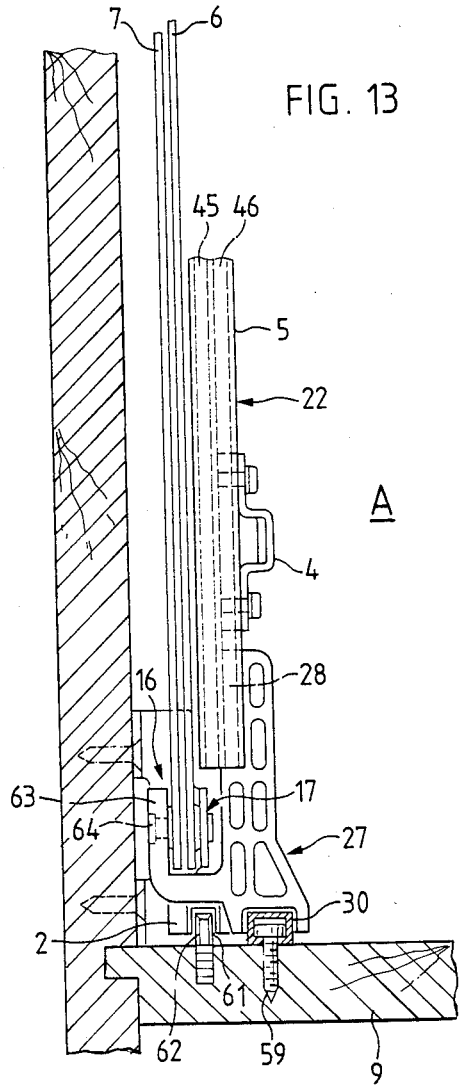
FIG. 13 is a detail side view showing the base-side end of the stop bar with a base piece.

FIGS. 12 and 13 show areas B (FIG. 12) and A (FIG. 13) in a view in which the construction of the lower and upper guides 30, 52 and the base and head pieces 27, 50 can be seen. The reciprocal position of the scissor arms 6, 7 and swivel joints 16, 17, as well as the slide-swivel joints 18, 19 can also be seen. It is essential that with the base and head pieces 27, 50, the lower and upper guides 30, 52 can either be aligned with door 2 or laterally displaced with respect thereto. One guide can be aligned while the other guide is displaced. Screws 59, 60 are screwed into base 9 and stop 60 and over their heads can be slid the upper and lower guides 30 and 52 constructed as a profile strip and which is e.g. an aluminum strip. Screws 59, 60 are only used in the rear area of guides 30, 52, while the front end of the two guides 30, 52 are laterally adjustable and fixable by stops 31, 54 for adjusting door 2.

As shown in FIGS. 5 and 13,, a groove 60 is made in the lower side of door 2 and into which projects a short web 62 fixed in base 9. The function of web 62 is to prevent the door 2 from striking against side 12 during sliding back or drawing out. The slid in door 2 can also be supported on web 62. Web 62 is set back from the door front, so that groove 60 does not have to extend up to the front end of door 2.

Figure 14:
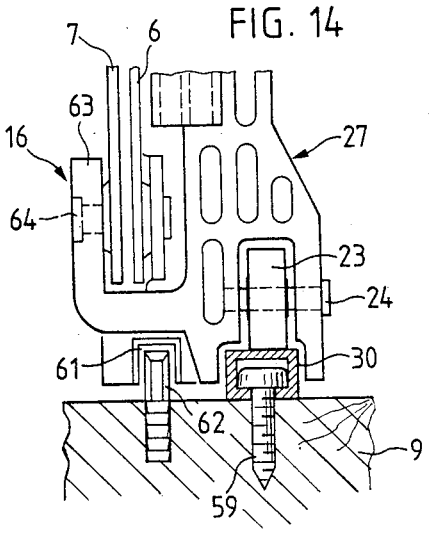
FIG. 14 is a larger scale detail view of a portion of the structure of FIG. 13 showing a castor guide for the stop bar.

As has already been stated, the special shape of the base and head pieces 27, 50 permits the lateral arrangement of the upper and lower guides 30, 52. However, pieces 27, 599 can also be constructed in such a way that the upper and lower guides 30, 52 can be positioned directly below or within the door. However, assembly is particularly advantageous in the construction shown in FIGS. 12 and 13. In FIG. 14 a castor or roller 23 with a bolt 24 is mounted in base piece 27, so that the lower guide 30 forms a bearing surface for said castor 23.

The shape of base piece 27 differs slightly from that of head piece 50, in that it forms a fork 63 on the side remote from lower guide 30 and together with the end of scissor arm 7 and a bolt 64 it forms the swivel joint 16. Fork 64 has sufficient space, so that in the completely slid back position of door 2, joint 17 can be received therein.

With the stop bar 6 having the two dovetail grooves, 45, 46 and with the base and head pieces 27, 50, the described scissor arm system has considerable advantages compared with the known embodiment. Due to the fact that the stop bar 5 is not only guides but also supported on lower guide 30. The scissors arm system can employ lighter weight construction. The upper and lower guides 30 and 52 are installed on base 9 and below top 10 and laterally alongside door 2 and stop bar 5. Since the fitted lower and upper guides 30, 52 are adjustable, lateral adjustments can be made whereby the position of door 2 can be adjusted. Normal precision requirements apply during assembly. A further advantage is that with the furniture housing assembled. A further advantage is that with the furniture housing assembled, it is possible to subsequently install the scissor arm system 6, 7 with the stop bar 5, because no grooves are necessary in base 9 and in top 10.

Figure 15:
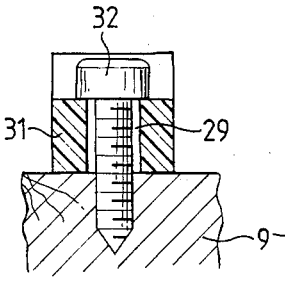
FIG. 15 is a sectional view, in larger scale taken along line XV—XV in FIG. 4.
Figure 16:
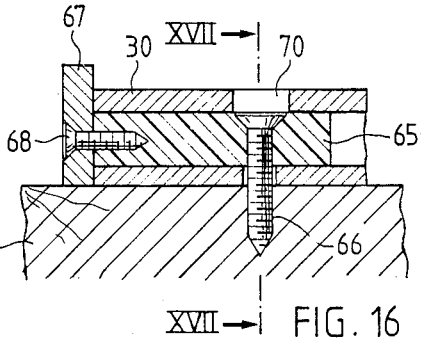
FIG. 16 is a longitudinal section of another embodiment illustrating the stop for the guides of the stop bar.
Figure 17:
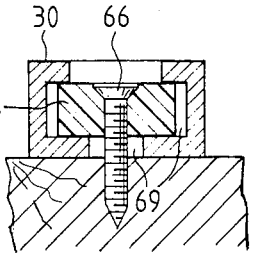
FIG. 17 is a sectional view taken along line XVII—XVII in FIG. 16.

FIG. 15 shows stop 31 on a larger scale. The lateral displaceability thereof and therefore of the guide is ensured by a slot 29. FIGS. 16 and 17 show a further stop on a larger scale and comprises a retaining block 65 fixed by a screw 66. Over said block is slid the aluminum dovetail profile forming guide 30 or 52. At the front a stop plate 67 is fixed with a screw 68. Retaining block 65 has a lateral clearance 69 and also access to the head of screw 66 is formed by a slot 70.

Due to the fact that the lower and upper guides 30, 52 are placed on the base and below the top, essential improvements compared with known systems can be achieved. There is no need for forming grooves and for gluing guides 30, 52 in base 9 and top 10. Thus, after the furniture has been assembled, a decision can be made either to use a nonsliding door or a sliding door. It is also much easier to subsequently reequip a piece of furniture with a sliding door.

Due to the mounting of guides 30, 52, a lateral displacement can be obtained in technically simple manner with the aid of stop 31 or 65, 66. Thus, the door can be laterally adjusted in the closed position.

While the fundamental novel features of the invention have been shown and described and pointed out, it will be understood that various substitutions and changes in the form of the details of the embodiments shown may be made by those skilled in the art without departing from the concepts of the invention as limited only by the scope of the claims which follow:

What is claimed is:

1. An assembly for a cabinet having a front vertical wall with an opening therein, a rear vertical wall, opposite vertical side walls disposed between said connecting the front and rear wall, a horizontal top and a horizontal bottom interconnected by the front side and rear walls, and a hollow interior, the top and bottom having exposed inner surfaces, the assembly being employed to mount a door in the opening and comprising:

first and second vertically inclined elongated scissor members, each member having a center, the centers being aligned, the members being pivotally secured to each other at their aligned centers and lying in a vertical plane, the first member having first and second opposite ends, the second member having third and fourth opposite ends, the scissor members being disposed in said interior and being movable between a compressed first position and an expanded second position;

a vertical elongated third member disposed in the interior, said third member having a central section connected at one end to a head piece and at the opposite end to a base piece, the first end being pivotally secured and vertically slidable with respect to the central section, the fourth end being pivotally secured to the base piece, each of the head and base pieces having a separate groove, these grooves being laterally displaced with respect to the central section;

upper and lower individual guides secured to the inner surfaces of the top and bottom respectively, the upper guide projecting into the groove of the head piece and being enveloped thereby, the lower guide projecting into the groove of the base piece and being enveloped thereby, the guides being secured to the inner surfaces at positions accessible from the front opening;

a vertical support fixed in position to the rear wall in the cabinet interior, the third end being pivotally secured to and vertically slidable in the support, the second end being pivotally secured to the rear wall.

2. The assembly of claim 1, characterized in that the front end of each of the upper and lower guides is provided with a stop, which is fixed to the guide.

3. The assembly of claim 1 wherein each of the base piece and head piece has a securing tongue, which engages the central section.

4. The assembly of claim 3 wherein a fork forms a part of a base-side fixed swivel joint of one of the scissors members and the third member is secured to the base piece and has additional space for receiving a base-side fixed swivel joint of the other scissors member and the support when the door is in open position.

5. The assembly of claim 4, wherein an auxiliary guide is disposed alongside of the lower guide which cooperates with a groove provided in the underside of the door and extending over part of the door length, so that the inserted door is supported at the front.

6. The assembly of claim 5 wherein each of the upper and lower guides is constructed as a profile strip with a dovetail groove, headed screws being screwed into bottom and top each profile strip being fixed to the door front by a corresponding laterally adjustable stop element.

7. The assembly of claim I wherein the cabinet has a door connected by hinges to the central section of the third member.

8. The assembly of claim 7 wherein at least the upper guide is displaced away from the door.

9. The assembly of claim 1 wherein the lower guide has an upper horizontal surface which defines a sliding and bearing surface for the base piece.

10. The assembly of claim 9 wherein the end of each guide disposed adjacent the front opening has a separate stop secured thereto.

11. The assembly of claim 10 wherein each stop is provided with a transverse slot, which permits the lateral adjustment of the corresponding guide.

* * * * *